United States Patent [19]

Bonerb

[11] Patent Number: 4,728,004

[45] **Date of Patent: * Mar. 1, 1988**

[54] MATERIAL-HANDLING AND DISCHARGE BIN OF THE TYPE HAVING A FLUID-EXPANDABLE FLEXIBLE MEMBRANE FOR DISCHARGE ASSISTANCE

[75] Inventor: Timothy C. Bonerb, Orchard Park, N.Y.

[73] Assignee: Bonerb, Vincent C., Buffalo, N.Y.

[ * ] Notice: The portion of the term of this patent subsequent to Jun. 16, 2004 has been disclaimed.

[21] Appl. No.: 686,532

[22] Filed: Dec. 26, 1984

Related U.S. Application Data

[63] Continuation-in-part of Ser. No. 500,821, Jun. 3, 1983, Pat. No. 4,574,984.

[51] Int. Cl.[4] ..... B65D 88/62

[52] U.S. Cl. ..... 222/61; 222/386.5; 222/389; 222/396; 222/642; 414/323

[58] Field of Search ..... 222/61, 63, 66, 638, 222/639, 95, 105, 202, 203, 386.5, 389, 52, 55, 642, 396; 414/323, 539; 280/743

[56] References Cited

U.S. PATENT DOCUMENTS

| | | | |
|---|---|---|---|
| 1,570,795 | 1/1926 | Tainton | 222/202 X |
| 2,931,523 | 4/1960 | Nelligan | 214/82 |
| 2,956,839 | 10/1960 | Hermanns | 222/386.5 |
| 3,097,768 | 7/1963 | Biehl et al. | 222/135 |
| 3,139,998 | 7/1964 | Seaman | 214/82 |
| 3,199,726 | 8/1965 | Pierson | 222/1 |
| 3,275,197 | 9/1966 | Eklund | 406/91 |
| 3,351,235 | 11/1967 | Paton | 222/1 |
| 3,941,258 | 3/1976 | Ide | 214/17 D |
| 3,994,324 | 11/1976 | Zeyra | 222/639 X |
| 4,449,646 | 5/1984 | Bonerb et al. | 222/95 |
| 4,453,645 | 6/1984 | Lisui et al. | 222/386.5 |

FOREIGN PATENT DOCUMENTS

| | | | |
|---|---|---|---|
| 650159 | 11/1964 | Belgium . | |
| 2351425 | 11/1973 | Fed. Rep. of Germany . | |
| 2705689 | 8/1978 | Fed. Rep. of Germany | 222/203 |
| 1032637 | 2/1963 | United Kingdom . | |
| 1144162 | 3/1969 | United Kingdom | 52/197 |

*Primary Examiner*—Joseph J. Rolla
*Assistant Examiner*—Frederick R. Handren
*Attorney, Agent, or Firm*—Bernard, Rothwell & Brown

[57] ABSTRACT

Improvements in bulk storage and handling systems of the type utilizing an inflatable membrane silo liner are disclosed. Included with the inflatable membrane are means for conforming the membrane to the silo or bin walls and means for substantially completing discharge of materials by a bin. The unique features disclosed are equally applicable to bins or silos having central or side discharge openings. Means are provided for avoiding discharge blockage by a membrane and improper membrane positioning during deflation. The invention further provides means for avoiding membrane damage due to improper loading techniques and means for avoiding excessive pressure buildup which might damage the membrane.

18 Claims, 13 Drawing Figures

PRESSURE RELIEF VALVE
VENT TO ATMOSPHERE
FROM ATMOS.
M
R
LS
T
A
B
C
P
50
12
14
16
18
20
22
24
26
28
30
32
34
36
38
40
42
44
46
48
52
54
56
58
60
70
76
76'
77
78
82
84
86
88
89
90
91
92
93
94
95
96
97
99
100
101
102
103
104
105
106
111
150
152
156
158
162
164
168
170
200
202
204
206
208

MATERIAL-HANDLING AND DISCHARGE BIN OF THE TYPE HAVING A FLUID-EXPANDABLE FLEXIBLE MEMBRANE FOR DISCHARGE ASSISTANCE

CROSS REFERENCE TO RELATED APPLICATIONS

This application is a continuation-in-part of copending prior application Ser. No. 500,821, filed June 3, 1983, now U.S. Pat. No. 4,574,984.

BACKGROUND OF THE INVENTION

1. Field of the Invention

This invention relates to improvements in bulk storage and handling systems and particularly to such systems that utilize a flexible inflatable membrane silo liner which inflates under low pressure to gently nudge material past its angle of repose and/or into a discharge cavity.

2. Background Art

Although material handling and storage bins such as silos have been known and widely used almost since the dawn of civilization, there is little art on such bins with flexible membrane fluid-assisted discharge. Such art as is known to Applicant has been cited in commonly owned U.S. Pat. No. 4,421,250, issued Dec. 20, 1983 and U.S. Pat. No. 4,449,646, issued May 22, 1984, and U.S. patent application Ser. No. 357,589, filed Mar. 12, 1982 and Ser. No. 357,592 filed Mar. 12, 1982 as well as PCT International application publication No. WO82/03839.

The most relevant of this background art appears to be U.K. patent No. 1,144,162 published March 1969 which shows a silo with a single flexible liner inflated from the bottom, and U.S. Pat. No. 3,941,258 to Ide which discloses a bulk storage and unloading apparatus having sidewalls and a liner with inflatable bladders between the sidewalls and liner.

In connection with the actual construction and installation of such silos using a flexible membrane discharge of the type disclosed in the above-identified prior applications, a number of problems have surfaced. These problems include incomplete discharge of materials by the bin, discharge blockage by the membrane, improper membrane positioning during deflation, membrane damage due to improper loading techniques (user related problems), and membrane damage due to excessive pressure buildup.

There remains a need in the art for improvements in flexible-membrane materials-handling bins which overcome the problems associated with their use.

SUMMARY OF THE INVENTION

This invention provides improvements in bulk storage handling systems of the type utilizing an inflatable membrane silo liner. It provides means for substantially completing discharge of materials by a bin. Means are provided for avoiding discharge blockage by a membrane and improper membrane positioning during deflation. The invention provides means for avoiding membrane damage due to improper loading techniques and means for avoiding excessive pressure buildup which might damage the membrane.

DETAILED DESCRIPTION OF THE PREFERRED EMBODIMENTS

Figure 1:
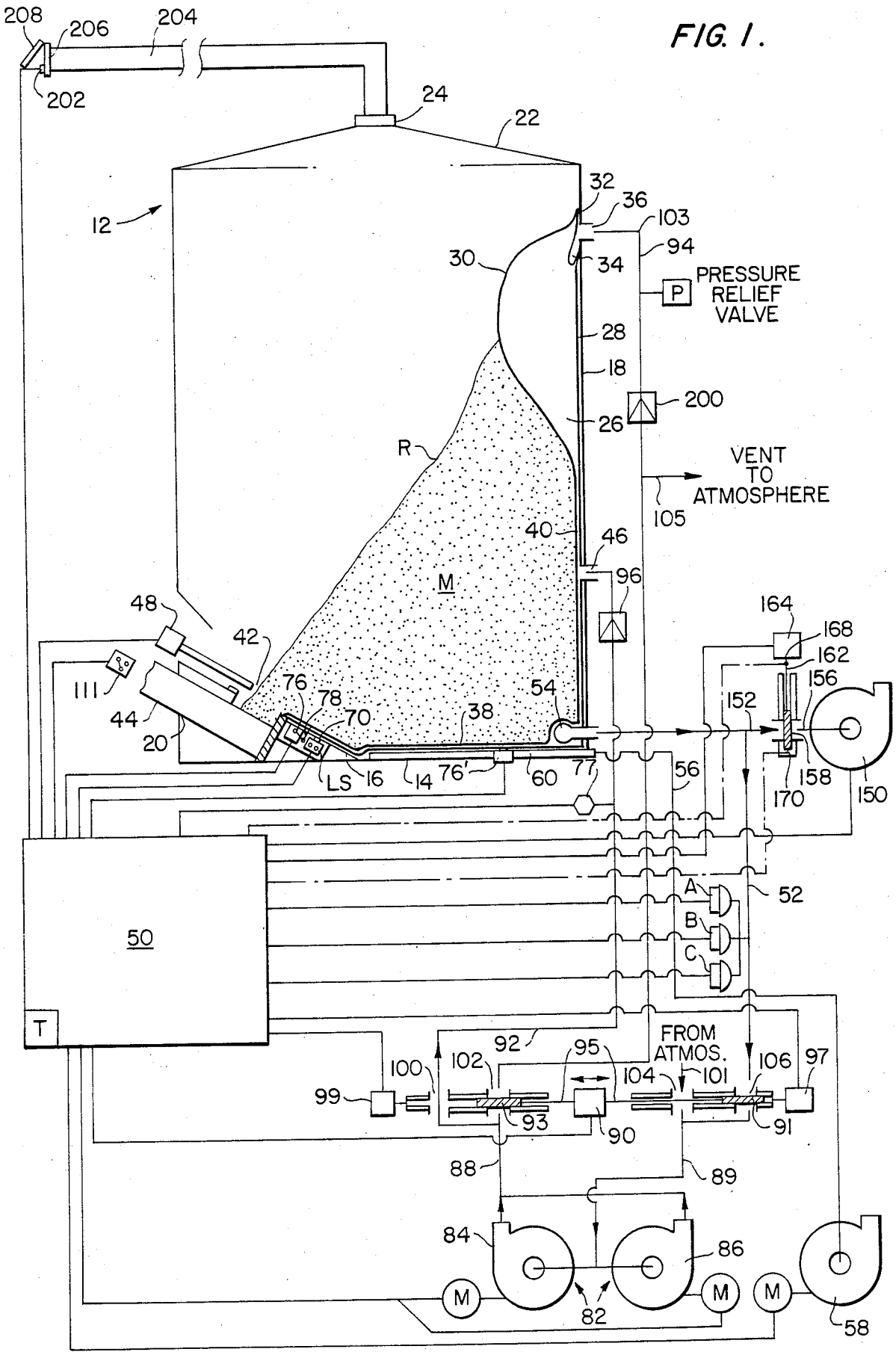
FIG. 1 is a schematic view showing a bin and bin controls according to one embodiment of the invention.

With reference to the drawings, a bin 12 of this invention is especially suitable and adapted for bulk storage, handling and discharging of free-flowing materials or granular, powdered or flaked materials or grains of varying degrees of flowability or susceptibility to caking, bridging or rat-holing. The bin is supported on a floor or other support 14, preferably having inclined shelf portion 16, and of suitable strength to bear the load of the material in the bin. The bin is constructed with sidewalls 18 which are preferably of light-weight steel panels. The sidewalls 18 may have formed therethrough an opening 20 for a discharge conveyor in the lower portion thereof.

The bin is optionally provided with a suitable top 22 which may be either metal or cloth and preferably has vent means therein (not shown) to allow venting of air from the bin when it is being filled while preventing loss of small particulate material. A material inlet 24 is provided for the introduction of material into the bin. The bin may be provided with a single wall inflatable liner as disclosed in U.K. patent No. 1,144,162, but is preferably provided with an inflatable, double-walled, flexible, generally cup-shaped bag or membrane 26 having outer and inner membrane walls 28 and 30 respectively. The bag is secured by clamp 32 or other support means to the sidewall of the bin. The bin preferably includes a separately inflatable balloon or annulus 34 with a separate inflation opening 36, the inflation and deflation of annulus 34 creating slack near the top of the inner membrane 30. The slack-creating annulus 34 may be located near the top of the bin as shown, or may be located along the bin sidewall near or at a vertical location corresponding to a distance above the bin floor represented by about ½ the bin's diameter. The slack created by annulus 34 eliminates undue stress on inner membrane wall 30 during initial inflation of the bag. The slack also reduces undue stress on the bag when loading it with material to be stored. Other means, such as springs or flexible cords (not shown) may be used to create slack near the top of the inner membrane wall 30. Inner membrane wall 30 includes a bottom portion 38 and sidewall portion 40 for storing the material M which may be discharged through a bag discharge opening 42 equipped with a suitable type gate or valve (not shown), or other suitable means, to control the discharge of material from the bin.

A bottom discharge opening may be located anywhere at the bottom of the bin, e.g., from the center to the side of the bin bottom. It is, however, preferable that the discharge opening not be located at the exact center of the bin bottom, i.e., the discharge opening is preferably at least slightly off-center. A discharge opening offset of the exact center of the bin bottom provides for assymetrical emptying of the bin, thereby reducing stress on the membrane during inflation. With a generally centrally located discharge opening, the discharge opening is preferably offset of center from about 5% to about 15% of the bin diameter and most preferably by about 8–9% of the bin diameter.

To discharge material from a bin constructed in accordance with this invention, the gate of the discharge opening 42 is opened. The contents of the bin may then flow out the opening to be carried away by a conveying means 44, such as a screw-type or other suitable conveyor, or into a moveable container for transport to a different area. Alternatively, when a screw-type or other conveyor is used, a discharge opening gate need not be provided, and flow through the discharge opening 42 may be initiated by turning on the conveyor and thereby removing material blocking the discharge opening.

Material will continue to flow out of the bin through the discharge opening by gravity until the angle of repose for the particular material in the bin is reached, or nearly reached, and a discharge cavity is created over the discharge opening. At the angle of repose, the inner face R of free flowing material assumes an inverted cone shape with its apex at the discharge opening and discharge of the material by gravity stops. With non free-flowing material, the angle of repose may be vertical, or bridging of material may occur across the discharge cavity.

An air inlet 46 is provided for gradually inflating the membrane 26 to nudge the material into the discharge cavity and through the discharge opening 42. Air under low pressure is forced into the bag between the inner and outer membrane walls. The bag begins to inflate at the top of the membrane and bulge inwardly toward the center of the bin. This inflation forces free-flowing material nearest the top of the inverted cone to cascade down toward the discharge opening by gravity. With non free-flowing material, the bulge causes material to fall into the discharge cavity and through the discharge opening.

A discharge sensor or probe 48 may be positioned in the discharge area near the discharge opening for detecting discharge of material. When probe 48 senses no material flowing through the discharge opening, the probe sends a signal to a control box 50 (see FIGS. 1 and 2) to start inflating the bag by relatively low pressure from blower system 82 having one or more blowers, two of which, 84 and 86, are shown in FIG. 1. Alternatively, the probe 48 may be positioned at some other point along the conveyor in the path of the discharging material. The probe operates in concert with other controls as described in copending application Ser. No. 500,821 and discussed in more detail below, to cause the discharge to be cyclical and the membrane to be periodically inflated as required by the material flowing into the discharge opening.

Figure 3A:
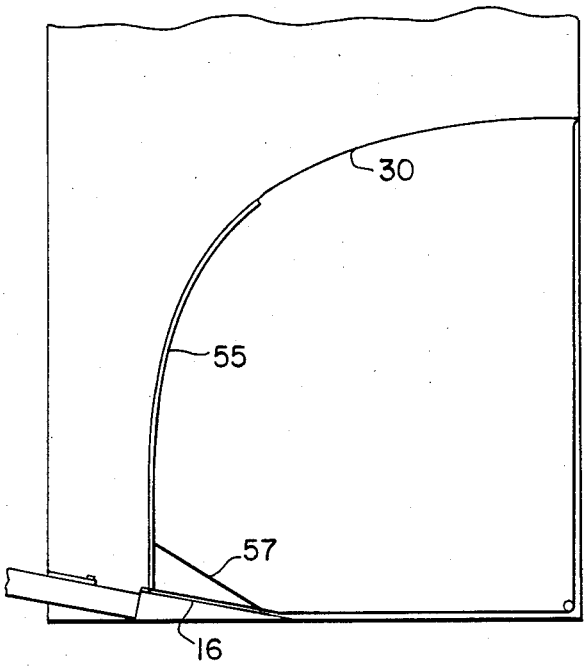
FIG. 3A is a schematic view of an inflated bin showing a batten attached to the flexible membrane, and an elastic cord extending between the batten and the floor of the bin.
Figure 3B:
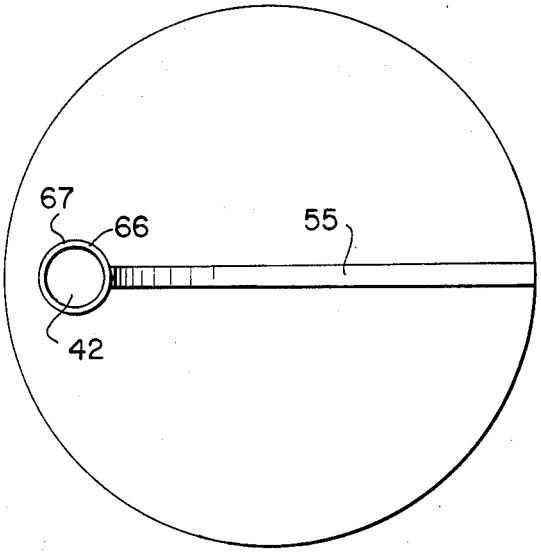
FIG. 3B is a top plan view of a deflated inner membrane according to one aspect of the invention, showing a batten attached to the bottom of an inner membrane.
Figure 8:
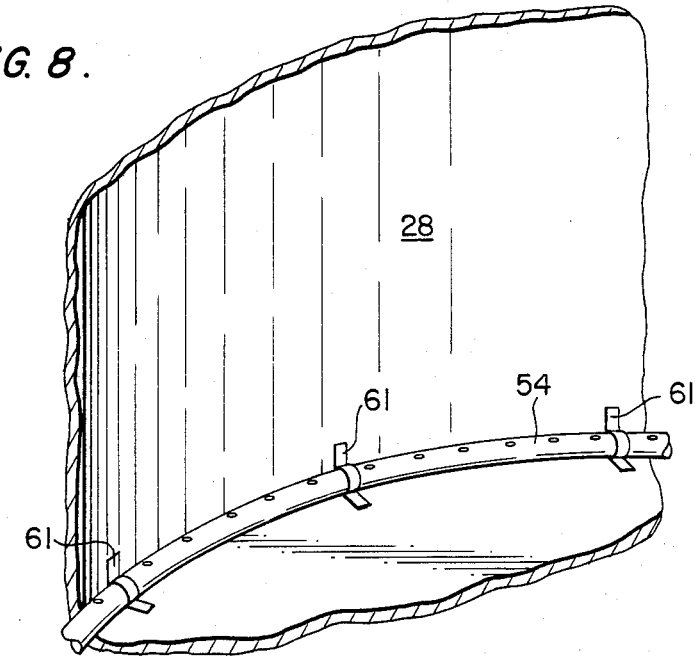
FIG. 8 is a perspective view with portions broken away of the inside of an outer liner wall showing a perforated suction tube and means for attaching the tube to the wall.

A vacuum line 52 connected to a perforated vacuum hose 54 (see FIGS. 1 and 8) is positioned between the outer membrane wall 28 and the inner membrane wall 30 of bag 26 at the outside periphery of the bottom of the inner wall to assure that the inner wall assumes its original position during deflation. Additionally, one or more flexible battens. 55 (one of which is shown in FIGS. 3A and 3B) may be attached to the bottom of inner wall 30, using any suitable means such as pockets or adhesive, to stiffen the bottom of the inner wall 30 and thereby assist the inner wall in assuming its original position during deflation. Battens may be constructed of any suitable materials such as plastic-like material, tubing filled with pellets, and the like. One or more elastic cords (or bungee cords) 57 may also be provided to assist movement of the bottom of the inner wall 30 back to its original position during deflation. One end of each bungee cord 57 is secured to the bottom of the inner flexible membrane 30 near the discharge opening 42, preferably at the location of a batten 55. The other end of the cord 57 is secured to the floor of the bin, or the inclined shelf 16, preferably a greater distance from the discharge opening than the cord end attached to the bottom of membrane 30.

The perforated vacuum hose 54 may be anchored through the outer wall 28 to effectively anchor the outer wall around the periphery of its bottom to the floor support 14 or the sidewalls 18. Alternatively, the perforated vacuum hose 54 may be secured to the inner bottom periphery of the outer wall 28 by means of guides 61 heat sealed to the bottom and side of outer membrane wall 28. See FIG. 8.

Figure 6:
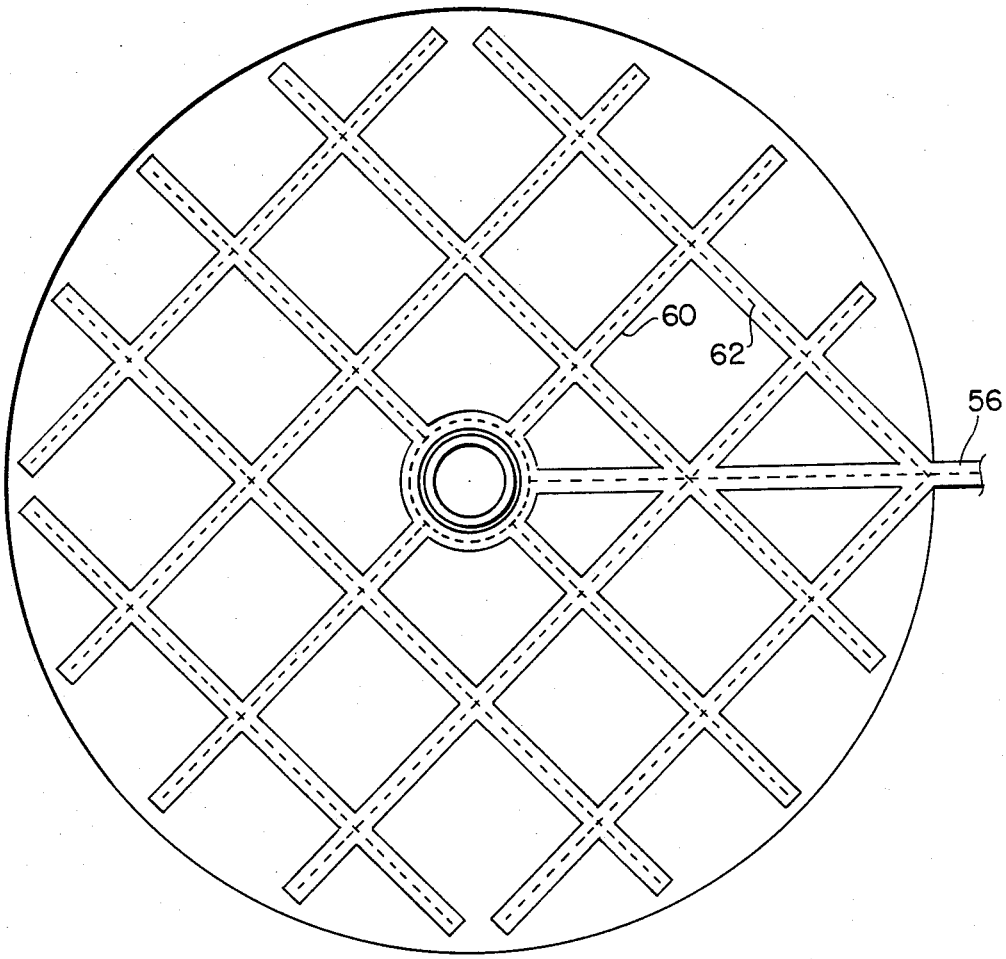
FIG. 6 is a top plan view of a bin floor and outer membrane positioning means.

Additional means for keeping the outer membrane wall 28 of the dual-walled flexible bag 26 against the sidewall 18 and floor 14 of the bin is shown in FIGS. 1 and 6. These means may include vacuum connection 56 leading to the intake of an auxiliary suction blower 58. As shown, the vacuum connection 56 is in direct communication with a plurality of connected bottom channels 60 in the floor of the bin the channels having perforations 62 which face the interior of the bin. By applying vacuum to these channels, the outer membrane 28 is held in position against the bin side and floor portion during the deflation cycle of the discharge operation.

Figure 4:
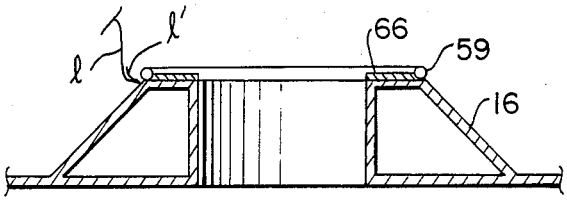
FIG. 4 is a cross-sectional partially schematic view of a discharge opening of a bin according to one aspect of the invention, showing a rounded edge discharge opening clamp.
Figure 5:
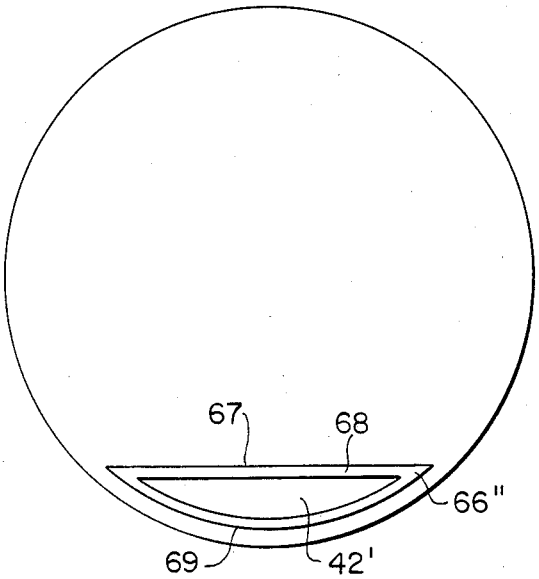
FIG. 5 is a top plan view of an elongated discharge opening according to one aspect of the invention.

The flexible bag is secured about the discharge opening 42 by a clamping member 66. See. FIGS. 3B, 4 and 5.

Depending upon the flowability and other characteristics of the material such as hydroscopicity, compaction, granular size, etc., in brown sugar or plastic pellets for example, the shape of the clamping member may be circular, irregular or non-symmetrical to provide a suitable "restraining" area 67 (see FIGS. 3B and 5) of attachment defined by the outermost perimeter of the clamping ring for attachment of the membrane. For example, in a nine-foot-diameter bin having a discharge opening varying from 12 inches to 20 inches in diameter (approx. standard size) the normal restraining or attachment area required would have a perimeter of approximately 50 inches. Thus the clamping member would be configured or shaped such that a restraining perimeter of 50 inches would result where the membrane is attached. In an 18-foot-diameter bin with a standard size discharge opening, a clamping member configured to have an attachment perimeter of from about 190 to about 250 inches would be required to effectively guide the flexible membrane during inflation so as to prevent excessive creasing and folding and thereby trapping material between folds as it is discharged.

In another embodiment, discharge is improved in a side discharge bin by providing an elongated discharge opening 42' as shown in FIG. 5. Clamping member 66" secures the flexible membrane in an area of the discharge opening 42'. The restraining area 67 around the discharge opening is defined by a chord 68 which is connected to an arcuate portion 69 of the clamping member along the periphery of the bag bottom.

It is preferable that the edge of the clamping member 66 be rounded where it may contact inner wall 30 during inflation. This may advantageously be provided by a pipe 59, welded around the edge of the clamping member 66. See FIG. 4. The rounded edge or pipe prevents the inner wall 30 from bearing against a sharp edge surface and possibly tearing during inflation. This is particularly important when the discharge opening is off-center of the bin. With an off-center discharge opening, one side of the bin is completely discharged prior to completion of discharge of the other side of the bin, and stress is created at points of contact between the inner wall 30 and the clamping ring 66. It is, therefore, particularly preferable to provide the inner wall 30 with more than one ply or layer 1,1' of bag material in the area surrounding the discharge opening where the membrane bears against the clamping member. Additionally, slack may be provided in the floor of inner wall 30 around the discharge opening 42 to further reduce stress on the membrane and avoid tearing during the final stages of discharge.

Figure 9A:
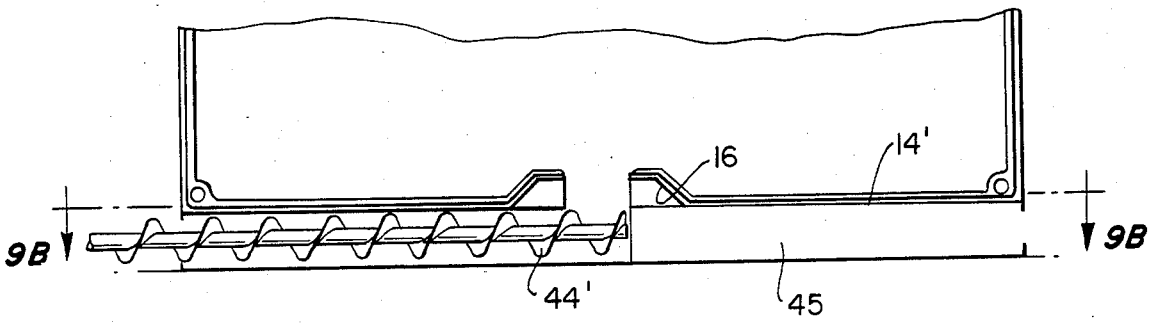
FIG. 9A is a schematic cross-sectional view of central discharge bin false floor showing discharge and access components.
Figure 9B:
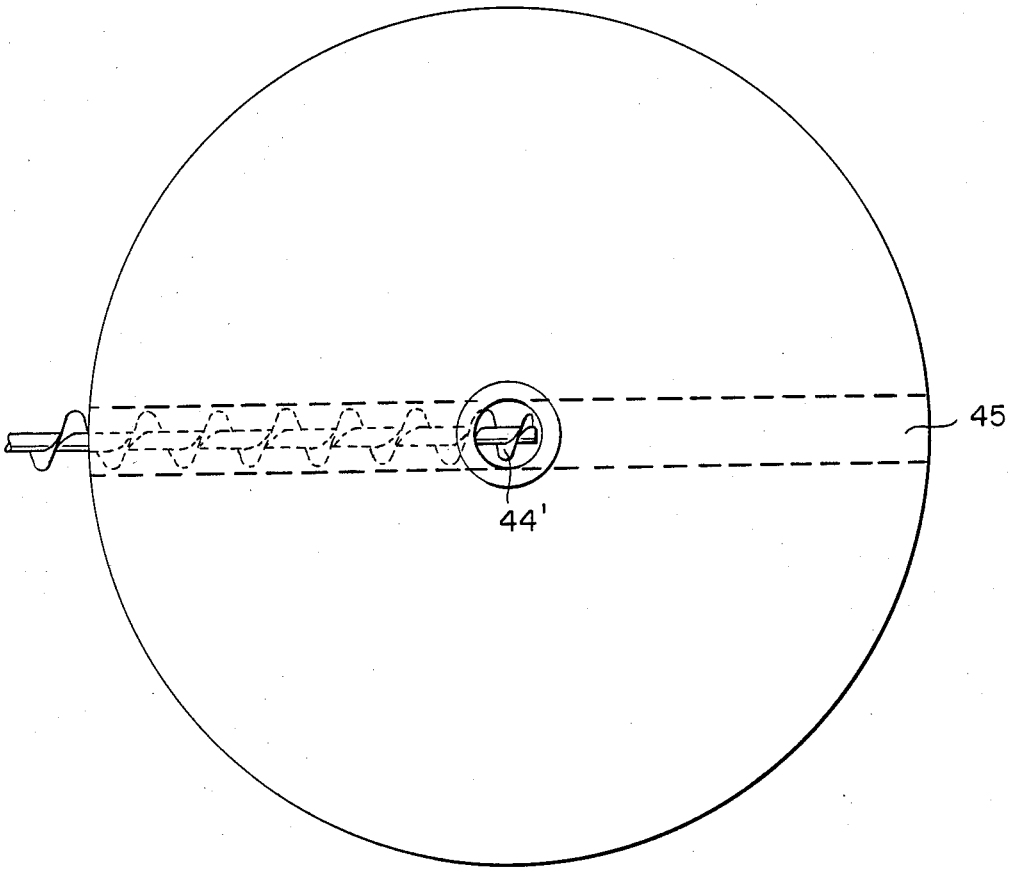
FIG. 9B is a top plan view along line 9B—9B of FIG. 9A.

A generally central discharge bin may be provided with an elevated false floor 14', in order to provide space for a discharge conveyor 44'. See FIGS. 9A and 9B. Additionally, a crawl space or manhole 45 may be provided for servicing the conveyor or discharge area in the event of failure or blockage.

Both generally central and side discharge bins are preferably provided with a discharge opening elevated from the floor of the bin, and an inclined shelf 16 leading up to the discharge opening. See FIGS. 1, 3A, 4 and 9A. In a central discharge bin, the inclined shelf is conical, and extends between the discharge opening and the floor of the bin. The inclined shelf provides resistance against the loaded membrane and shifts the center of gravity of the load away from the discharge opening so that the membrane cannot inch forward even though the membrane liner has lifted off the floor during inflation. Without this resistance, a possible air cushion forming beneath the liner may allow forward movement of the inflating membrane and material supported thereon. This might cause an excess of slack membrane liner material to "bulge" or collect at the discharge opening and prevent the membrane from resuming its original configuration against the bin wall during the deflation cycle if the bin were not completely emptied of material. Should this occur, the liner could fail to assume or conform to its normal position during deflation. The inclined shelf 16 also prevents excessive folding of the inner membrane at the discharge area which might restrict or block the flow of material during discharge.

Figure 2:
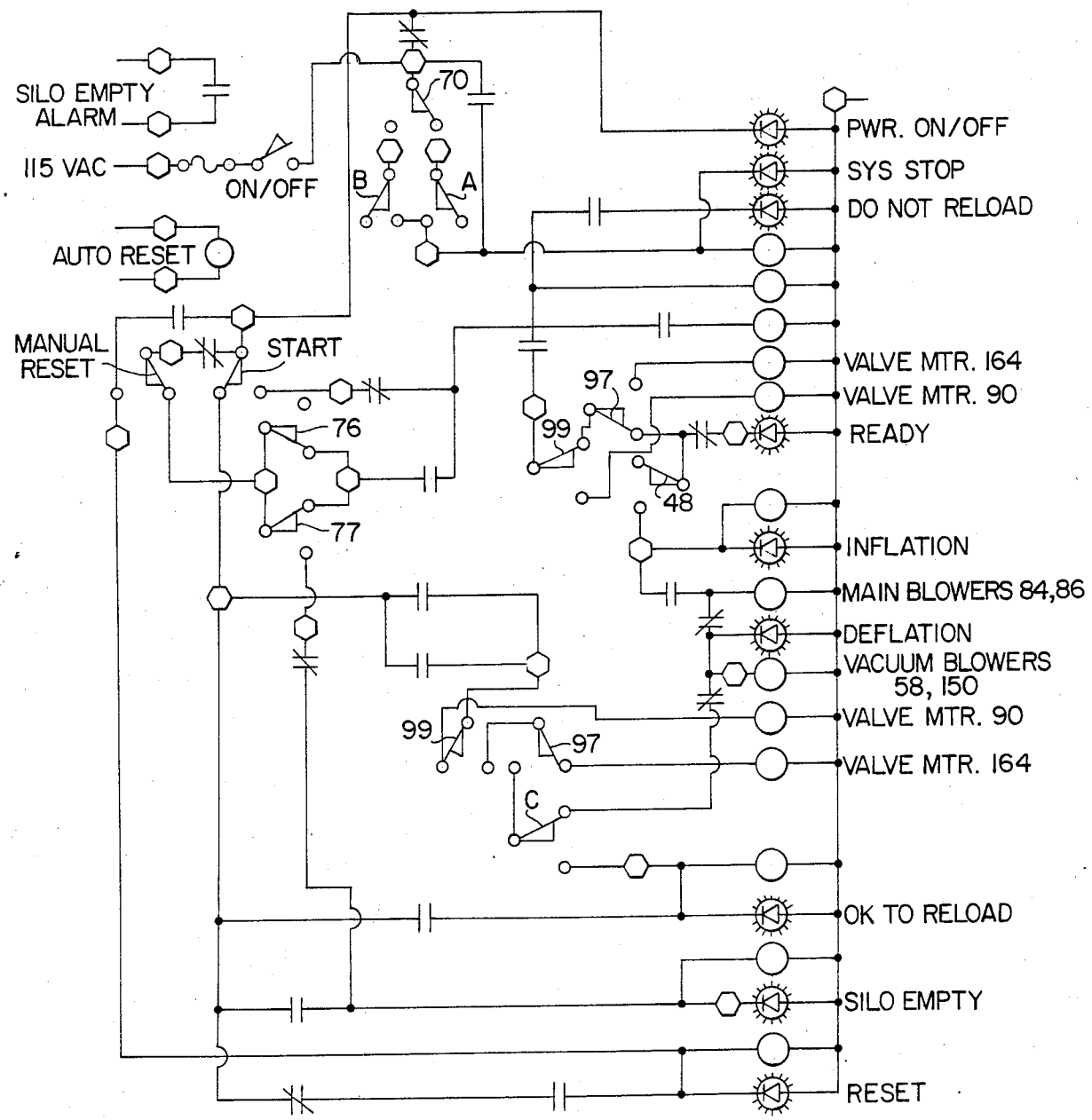
FIG. 2 is a schematic view of bin control circuitry according to one embodiment.

Referring to FIG. 1 and the control circuitry shown in FIG. 2, a bin 12 of this invention is especially suitable and adapted for bulk storage and handling (discharging) free-flowing or other granular material by means of automatic controls.

In operation, the bin is initially filled with the bulk material to be stored, e.g., sugar, rice, corn, powders, grains, etc. When it is desired to discharge material from the bin, conveyor 44 is turned on to remove material blocking the discharge opening. Material then flows out of the bin through the discharge opening under the influence of gravity, and is carried away by conveyor 44, until a discharge cavity over the discharge opening 42 is created and the pressure-sensitive sensor (probe) 48 is uncovered. When the absence of material is sensed, probe 48 sends a signal to the control box 50 to start inflating the bag by relatively low pressure from the blower system 82. As upper portion of the membrane starts inflating, the inner wall 30 bulges inwardly and nudges the material towards the discharge opening and out of the bin. During discharge, when the material covers the probe 48, the inflation stops. A check valve 96 holds the low pressure, and the material discharges by gravity until it again uncovers the probe. This cycle is many times repeated during a discharge.

A single blower system 82 may be provided for both inflation and deflation of the bag. The blower system 82 may include one or more blowers, two blowers 84 and 86, being shown in FIG. 1. Suitable conduit lines are connected to blower system 82 including outlet line 88 and inlet line 89.

The blower system 82 cooperates with a valve system including four valve passages, namely, valve passage 100 for inflation cycle pressure, valve passage 104 for inflation cycle suction, valve passage 102 for deflation cycle pressure, and valve passage 106 for deflation cycle suction. The valve passages 100, 102, 104 and 106 cooperate with two valve gates 91 and 93. Valve gates 91 and 93 are connected together through linkage 95, and are driven simultaneously by servo motor 90, or other suitable drive means such as pneumatic, hydraulic, electric or solenoid, under the direction of control box 50. Valve gates 91 and 93 alternately open or close the respective pairs of valve passages. The valve gates are shown in the inflation cycle position in FIG. 1.

The valve gates contact limit switches at 97 and 99 which, through control box 50, control the operation of motor 90. That is, after motor 90 puts the valve gates 91 and 93 into position shown in FIG. 1, a limit switch at 97 will stop the motor 90. Similarly when the motor 90 puts the valve gates 91 and 93 into position closing valve passages 104 and 100, respectively, and thereby opening valve passages 106 and 102, a limit switch at 99 operates to control and stop motor 90.

As shown in FIG. 2, limit switches at 97 and 99 also complete circuitry which puts the system into inflation and deflation cycles.

The valve system controls whether blower system 82 is directed to inflating the inflatable bag through line 92 while drawing air from the atmosphere, or inflating annulus 34 through line 94 and check valve 200 while deflating bag 26 through line 52.

During the inflation cycle in which blower system 82 is periodically operated to apply pressure, air under pressure flows through line 88 and open valve passage 100, then through line 92 to an inflation opening 46 in the double-walled inflatable bag. In the line 92 leading to inflation opening 46 is a check valve 96 so as to prevent deflation of the bag when the probe 48 signals the blower system 82 to turn off.

Air to supply the blower system 82 through inlet line 89 comes from an open end 101 of line 89 leading to the atmosphere and passes through open valve passage 104. When the blower system 82 is in a dusty environment, it is preferable that dust-free air be piped to the blower system through line 89 from a suitable source external of the dusty environment, or an air filter be used to clarify the air.

To assist in determining the extent to which the membrane has inflated which in turn would indicate the amount of material remaining in the bin, a limit switch 76' may be provided as shown in FIG. 1. Limit switch 76' is activated when the membrane has inflated to a predetermined point which in turn signals the operator that additional material may be introduced into bin 12 if desired.

As disclosed in copending application Ser. No. 500,821, and shown in FIG. 1, a silo empty sensor in the form of a toggle limit switch 76 has a flexible tether 78 connected to switch 76 and to the inner bag wall 30. When the bag 26 is substantially empty at the end of the inflation cycle, the tether 78 is pulled taut and operates the limit switch 76. At that time, limit switch 76 through control box 50 causes the motor 90 to reverse, moving the valve gates 91 and 93 to close valve passages 104 and 100, respectively, thereby opening valve passages 106 and 102. Alternatively, a mercury switch which monitors the bag wall position could be used in place of the toggle switch and tether.

Additionally, the inflation cycle may be further controlled by means including discharge cycle sensor switch 70 which is pre-set to control monitoring of air pressure applied to the bag by the blower system. This is accomplished by allowing sensor switch 70 to selectively activate sensors A and B during the discharge cycle. Sensor A monitors the air pressure within the membrane until it lifts off switch 70. When the bottom portion 38 of inner membrane 30 is resting against the bottom of bin 12, sensor switch 70 is depressed and operates sensor A so that the air pressure within the membrane is below about 50 inches water, i.e., within normal limits. If the air pressure exceeds its normal limits due to, for example, blockage of the discharge opening, sensor A shuts off the blower system and a visual signal at the control box is illuminated. Near the completion of the discharge cycle, the membrane will lift off of sensor switch 70. At this time switch 70 will deactivate sensor A and activate sensor B through control box 50 and sensor B continues to monitor the air pressure condition of the membrane. Sensor B is set to shut off the blower system at a pressure which is lower than will activate sensor A, to avoid stress on the bag if abnormally high pressure should develop as the discharge cycle nears completion.

If the system is functioning properly and the air pressure is within pre-determined limits, limit switch 76 connected by a flexible tether 78 to the underside 38 of membrane 30 will be activated when tether 78 is pulled taut due to the membrane being fully inflated. This indicates that the bin is substantially empty, and the deflation cycle will be initiated and bag 26 will be emptied of air by blower system 82.

As shown in FIGS. 1 and 2, a silo-empty pressure switch 77 may be utilized in addition to tethered limit switch 76 to signal the end of the deflation cycle. According to this embodiment, during the final stages of inflation, inner membrane 30 rises off the floor of the bin, pulling tether 78 taut which throws limit switch 76. In order to provide for complete emptying of the bin, limit switch 76 does not trigger deflation of the bag, since blowers 84 and 86 remain on under the control of pressure switch 77 and probe switch 48, which remains uncovered. Pressure switch 77 is set to permit sufficient pressure to build up within the bag (e.g., 9 inches of water pressure), to ensure that the bin is completely empty of material. When the pressure within the bag reaches 9 inches of water pressure, pressure switch 77 is activated and signals for deflation to begin. Pressure switch 77 provides for complete emptying of the bag even if tether 78 is out of adjustment.

If during the discharge cycle sensor B detects abnormally high pressure within membrane 26 such as might be caused by broken tether 78 or other malfunction, the cycle is interrupted and a visual signal on the control box is illuminated. As a further safety backup, conveyor means 44 may be provided with switch 111. If the conveyor should malfunction or be turned off for any reason while the rest of the system is functioning, then switch 111 will shut the system down.

As an additional safety measure, control box 50 may include timer T means which monitors the amount of time during which the blower system is continuously operated. The timer means may be set to shut the system down if the blower system continuously operates for a period of time which might overheat the blower or indicate discharge blockage, e.g., 30 to 45 seconds.

Since introduction of material into the bin during discharge might rupture the inner membrane 30, the discharge control system may be provided with means for resetting the discharge system in the event that bulk materials are introduced into the bin during a discharge cycle.

A microswitch 202 is provided for automatically resetting the discharge system to deflate the bag if bulk materials are introduced into the bin during a discharge cycle. Bins which are located within a processing plant generally have a pneumatic fill line 204 running from the bin to a location outside of the plant where a bulk tanker (not shown) can hook up to the inlet 206 of the fill line 204 to load the bin. When a connection is made between the bulk tanker and the pneumatic fill line 204, material from the bulk tanker is conveyed pneumatically through the fill line and into the bin. To prevent introduction of bulk materials into a bin during a discharge (inflation) cycle, a cover 208 is provided over the inlet of the fill line which must be opened before a connection betwen a bulk tanker and the fill line can be made. A microswitch 202 is provided at the cover which is activated when the cover is opened and signals the bin control box 50 to activate the reset circuitry and deflate the bag.

Alternatively, the resetting means may include a motion sensor or probe (not shown) positioned at the bin inlet 24, which signals control box 50 when material is entering the bin. Control box 50 then signals the valve and blower system to shift into the deflation cycle and remove air from the bag.

When the bin is emptied and control box 50 initiates the deflation cycle, the blower system 82 blows air through line 88, valve passage 102, and line 94. Air pressure at the end 103 of line 94 inflates the slack creating inflatable annulus 34 within the walls of the double-walled bag. Within the line 94, there is a check valve 200 to prevent reverse flow and deflation of the annulus 34 when the blower system 82 is turned off at the end of the deflation cycle. Positioned in the line above check valve 200 is a pressure relief valve P so that excess pressure within inflatable annulus 34 may be relieved when material introduced into the bin compresses the annulus. There is further provided a restrictive vent 105 to the atmosphere to allow excess pressure to be vented during the deflation cycle.

Suction is pulled on line 89 by blower system 82 and suction line 52 leading through valve passage 106. Line 52 connects to the perforated vacuum tube 54 to apply suction, i.e., pull a vacuum within the walls of the inflatable bag 26, and return it to its original position for receipt of another load of granular material.

When bag 26 is depleted of air and inner wall 30 has settled back and conformed to the silo wall and floor, a momentary vacuum, e.g., equivalent to about 10 inches of water, occurs which will activate vacuum sensor switch C. Sensor switch C then sends a signal to control box 50 shutting off the blower system 82. Alternatively, blower system 82 may be controlled at the end of a deflation cycle by a timer means (not shown) activated at the beginning of a deflation cycle through control box 50 and set to shut off blower system 82 after a time sufficient to deflate the bag.

As discussed above, the outer wall 28 of the dual-walled flexible membrane 26 may be retained against the wall 18 and floor 14 of bin 12 by employing vacuum connection 56 in conjunction with the auxiliary suction blower 58. This vacuum connection communicates with perforated channels 60 to hold the outer membrane wall of the bag snugly against the bin sidewall and floor during deflation.

With large bins, e.g., bins which are 15 feet in diameter or more, it is particularly preferred to provide a supplemental suction blower system 150 in addition to primary blower system 82. A supplemental suction blower system aids in deflation of the bag, thereby reducing stress on the primary blower system.

The supplemental suction blower system preferably includes one or more high-volume, low-pressure blowers, e.g., capable of moving 800–1000 cubic feet of air per minute at a pressure of 2–6 inches of water. A suitable blower is the Cincinnati Model SP-12 which can move 835 cubic feet per minute at 2 inches of water pressure.

Figure 7A:
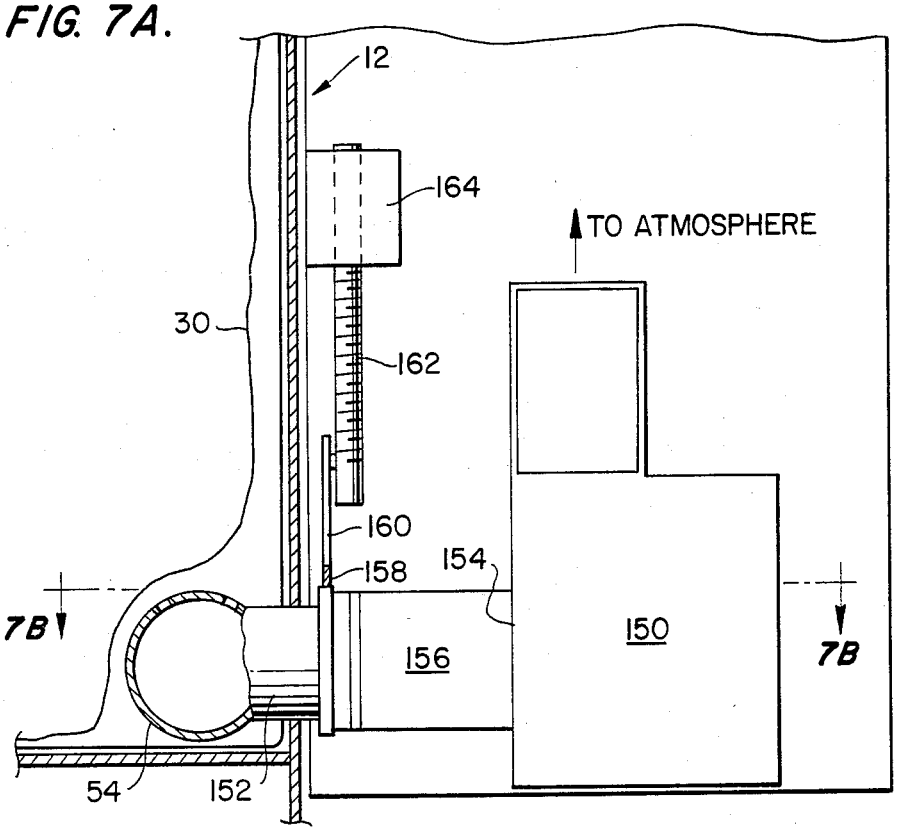
FIG. 7A is a partial detailed elevational view, partially schematic with portions broken away, showing a supplemental suction blower and related components for deflation during a discharge cycle of a bin.
Figure 7B:
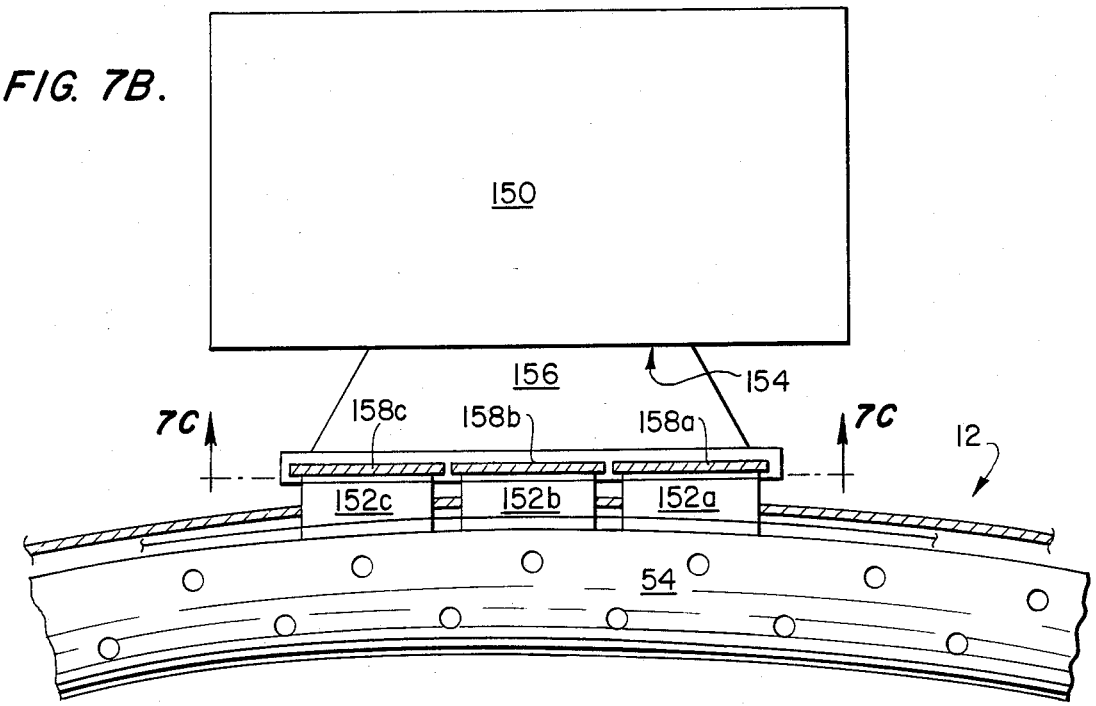
FIG. 7B is a partial detailed elevational view, partially schematic along line 7B—7B of FIG. 7A.
Figure 7C:
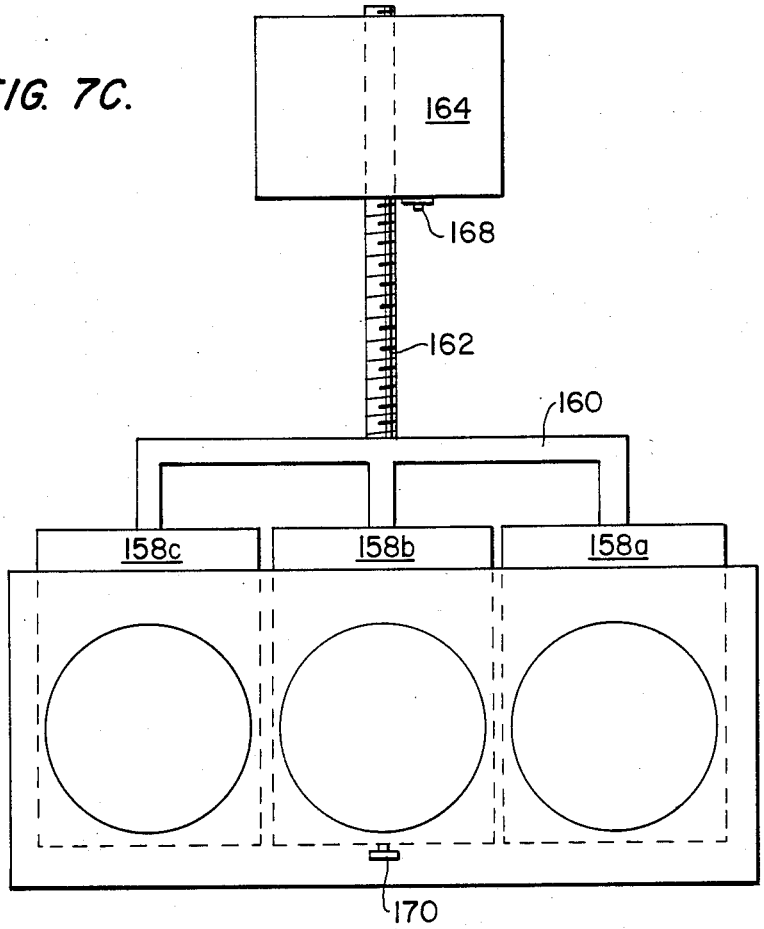
FIG. 7C is a schematic view along line 7C—7C of FIG. 7B.

The supplemental suction blower system 150 is preferably located in close proximity to the storage bin 12. See FIGS. 1, 7A, 7B and 7C. One or more perforated tube outlets 152 (three of which are shown in FIG. 7B) connect perforated tube 54 to the intake 154 of supplemental blower system 150 by suitable means such as conduit 156. One or more gate valves 158 regulate the passage of air to supplemental suction blower 150 from perforated tube 54. As shown in FIGS. 7B and 7C, three interconnected gate valves **158*a*, 158*b* and 158*c* control air passage through conduit 156. The gate valves are interconnected by forked support member 160, and are operated simultaneously by means of screw drive 162 driven by valve drive motor 164. Alternatively, a single gate valve may control passage of air through tube outlets 152*a*, 152*b* and 152*c* to conduit 156**.

During the inflation cycle, gate valves 158 of the supplemental suction system remain closed, and inflation proceeds as described above. When activation of toggle limit switch 76 and pressure switch 77 indicates the end of the inflation cycle, the deflation cycle is initiated as described above, in addition to activation of the supplemental suction system as follows.

When control box 50 initiates the deflation cycle by activating valve motor 90 and blower system 82, valve drive motor 164 opens gate valves 158 and the supplemental suction blower system 150 is turned on. When the valves are fully opened, limit switch 168 is contacted by connection with the valves, and valve motor 164 is turned off.

At the end of the deflation cycle, sensor switch C sends a signal to control box 50, which in turn shuts off blower system 82 and supplemental blower 150, and activates motor 164 to close valves 158.

Alternatively, blower 150 may be connected to a timer which is set to shut the blower off after a suitable period of time has elapsed for deflation of the bag. When the valves 158 are fully closed, limit switch 170 is contacted by connection with the valves, and control box 50 turns off valve motor 164 leaving the system at rest.

Alternatively, limit switches 168 and 170 may be eliminated and valve motor 164 may be operated under the control of circuitry controlled by limit switches at 97 and 99 which are operated by main valves 91 and 93. See FIG. 2.

The supplemental blower 150 preferably has a capacity to provide a suction pressure at least equivalent to the suction pressure necessary to activate sensor switch C and shut off blower system 82. For example, if sensor switch C is set to shut off the blowers at a vacuum negative pressure equivalent to 10 inches of water, supplemental blower 150 is preferably capable of providing at least an equivalent amount of suction. If less suction is provided by blower 150, air will be drawn into the bin membrane through blower 150 towards the end of the deflation cycle when the negative pressure within the bin exceeds the suction of blower 150. If a supplemental blower 150 is used which is incapable of preventing air flow reversal towards the end of the deflation cycle, a unidirectional check valve (not shown) may be provided at the outlet of blower 150 which permits air to pass out of the bin but prevents air from passing into the bin through blower 150.

A silo empty alarm may also be provided which is activated at the end of a deflation cycle. See FIG. 2.

In an alternative embodiment, the bag 26 is both inflated and deflated by air passage through perforated tube 54 with suitable connections, in which case inflation opening 46 and connections thereto are eliminated.

As can be seen the invention disclosed provides substantial improvements in pneumatically assisted handling and discharge means for granular, powder or flake material.

Since many modifications, variations and changes in detail may be made to the described embodiments, it is intended that all matter in the foregoing description and shown in the accompanying drawings be interpreted as illustrative and not in a limiting sense.

What is claimed is:

1. A material-handling and storage bin of the type having an inflatable, dual-walled, cup-shaped bag, positioned inside a silo and clamped to the sidewalls of the silo adjacent the top of the bag, a discharge opening through the bottom of the bin, the bag assisting in gravity discharge of granular, powder or flake material after such material discharges to the extent allowed by gravity by nudging material into a discharge cavity through cyclical inflation of the inner wall of the dual-walled bag, with improvements for holding the outer wall of the dual-walled bag to the silo below the top of the bag, the improvements comprising means for applying vacuum between the floor of the bin and the outside of the outer wall of the bag, the means including a plurality of perforated channels in the floor of the bin.

2. A material-handling and storage bin of the type having a fluid-inflatable flexible membrane for assisting in gravity discharge of granular, powder or flake material after such material discharges to the extent allowed by gravity by nudging material into a discharge cavity through cyclical inflation of the flexible membrane, the material discharging through a discharge opening where the membrane is secured to the bin, the flexible membrane having a bottom and sidewall portions, the flexible membrane deflating and returning to its original position after discharge, with improvements for assisting the flexible membrane in returning to its proper deflated position after discharge, the improvements comprising at least one flexible batten attached to the bottom of the flexible membrane.

3. A material-handling and storage bin of the type having a fluid-inflatable flexible membrane for assistng in gravity discharge of granular, powder or flake material after such material discharges to the extent allowed by gravity by nudging material into a discharge cavity through cyclical inflation of the flexible membrane, the material discharging through a discharge opening where the membrane is secured to the bin, the flexible membrane having bottom and sidewall portions, the flexible membrane deflating and returning to its original position after discharge, with improvements for assisting the flexible membrane in returning to its proper deflated position after discharge, the improvements comprising at least one flexible batten attached to the bottom of the flexible membrane, further comprising one or more elastic cords having one end connected to said flexible membrane in the proximity of said batten near said discharge opening, and the other end connected to the floor of said bin near said discharge opening, the elastic cord applying tension to the flexible membrane when the flexible membrane is inflated, the elastic cord assisting the flexible membrane in returning to its proper deflated position during deflation of the membrane.

4. A material-handling and storage bin of the type having a bin sidewall, a bin floor, a fluid-inflatable flexible membrane for assisting in gravity discharge of granular, powder or flake material after such material discharges to the extent allowed by gravity by nudging material into a discharge cavity through cyclical inflation of the flexible membrane, the material discharging through a discharge opening where the membrane is secured to the bin, the flexible membrane having bottom and sidewall portions, the flexible membrane deflating and returning to its original position after discharge with improvements for assisting the flexible membrane in returning to its proper deflated position after discharge, the improvements comprising; at least one elastic cord, one end of the cord being secured to the bottom portion of the flexible membrane spaced away from the sidewall portion of the membrane and near the discharge opening, and the other end of the cord being secured to the floor of the bin spaced away from the sidewall of the bin and near the discharge opening, the elastic cord applying tension to the flexible membrane when the flexible membrane is inflated, the elastic cord assisting the flexible membrane in returning to the proper deflated position during deflation of the membrane.

5. A material-handling and storage bin of the type having a fluid-inflatable flexible membrane for assisting in gravity discharge of granular, powder or flake material after such material discharges to the extent allowed by gravity by nudging material into a discharge cavity through cyclical inflation of the flexible membrane, the material discharging through a discharge opening where the membrane is secured to the bin, with improvements for preventing the flexible membrane from tearing during expansion and discharge, the improvements comprising; a clamping ring securing the flexible membrane to the discharge opening in the bin, the discharge opening being elevated from the floor of the bin, and a downwardly inclined shelf extending between the discharge opening and the floor of the bin, the downwardly inclined shelf underlying and supporting a portion of the flexible membrane about the discharge opening to thereby resist horizontal movement of the flexible membrane and the material towards the discharge opening during inflation of the membrane and discharge of material said clamping ring having a rounded mating edge which bears against the flexible membrane on expansion of the membrane under pressure.

6. The bin of claim 5 with additional improvements comprising a flexible membrane having at least two layers of membrane material where the flexible membrane bears against the rounded mating edge.

7. The bin of claim 5 wherein said rounded mating edge comprises generally round pipe at points of bearing between the clamping ring and the flexible membrane.

8. The bin of claim 7 with additional improvements comprising a flexible membrane having at least two layers of membrane material where the flexible membrane bears against the rounded mating edge.

9. The material-handling and storage bin of claim 5 further including means for creating slack in said flexible membrane at a position near the top of the fluid-inflatable flexible membrane.

10. The material-handling and storage bin of claim 9 wherein said bin has a diameter and said position is at or near a vertical location on the flexible membrane corresponding to a distance above the bin floor represented by about one-half the bin diameter.

11. The material-handling and storage bin of claim 5 further comprising a bin bottom discharge opening offset of the exact center of the bin bottom by from about 5% to about 15% of the bin diameter.

12. The material-handling and storage bin of claim 11 wherein the discharge opening is offset by about 8–9% of the bin diameter.

13. A material-handling and storage bin of the type having a fluid-inflatable flexible membrane for assisting in gravity discharge of material after such material discharges to the extent allowed by gravity wherein said membrane assists in material discharge by nudging material into a discharge cavity through cyclical inflation of said flexible membrane such that the material discharges through a discharge opening where the membrane is secured to the bin, with improvements in controls for the bin comprising; means for applying fluid pressure to said flexible membrane; a first sensor for sensing the discharge of material, said first sensor controlling said means for applying fluid pressure to said membrane so that fluid pressure is applied to said membrane when discharge of material is not sensed and application of fluid pressure to said membrane is stopped when discharge of material is sensed; means for turning off said means for applying fluid pressure to said flexible membrane if membrane-damaging pressure is applied, said means for turning off said means for applying fluid pressure to said flexible membrane including a timer set to turn off said means for applying fluid pressure after a period of time of continuous fluid pressure application has passed which indicates the application of membrane-damaging pressure, a second sensor for sensing when the membrane has inflated to an extent indicative of a substantially empty silo; means for applying vacuum to retract said flexible membrane, said second sensor controlling activation of said means for applying vacuum; and means for turning off said means for applying vacuum when said flexible membrane has returned to its non-inflated position.

14. A material-handling and storage bin of the type having a fluid-inflatable flexible membrane for assisting in gravity discharge of material after such material discharges to the extent allowed by gravity wherein said membrane assists in material discharge by nudging material into a discharge cavity through cyclical inflation of said flexible membrane such that the material discharges through a discharge opening where the membrane is secured to the bin, with improvements in controls for the bin comprising; means for applying fluid pressure to said flexible membrane; a first sensor for sensing the discharge of material, said first sensor controlling said means for applying fluid pressure to said membrane so that fluid pressure is applied to said membrane when discharge of material is not sensed and application of fluid pressure to said membrane is stopped when discharge of material is sensed; means for turning off said means for applying fluid pressure to said flexible membrane if membrane-damaging pressure is applied; a second sensor for sensing when the membrane has inflated to an extent indicative of a substantially empty silo; means for applying vacuum to retract said flexible membrane, said second sensor controlling activation of said means for applying vacuum; means for turning off said means for applying vacuum when said flexible membrane has returned to its non-inflated position; and means for activating said means for applying vacuum if material is introduced into the bin during discharge of material from the bin.

15. A material-handling and storage bin of the type having a fluid-inflatable flexible membrane for assisting in gravity discharge of material after such material discharges to the extent allowed by gravity wherein said membrane assists in material discharge by nudging material into a discharge cavity through cyclical inflation of said flexible membrane such that the material discharges through a discharge opening where the membrane is secured to the bin, with improvements in controls for the bin comprising; means for applying fluid pressure to said flexible membrane; a first sensor for sensing the discharge of material, said first sensor controlling said means for applying fluid pressure to said membrane so that fluid pressure is applied to said membrane when discharge of material is not sensed and application of fluid pressure to said membrane is stopped when discharge of material is sensed; means for turning off said means for applying fluid pressure to said flexible membrane if membrane-damaging pressure is applied; wherein said means for applying fluid pressure and said means for applying vacuum comprise blower means for application of fluid pressure to inflate and deflate said flexible membrane, and further comprising timer means for shutting off said blower means during inflation if said blower means continuously operates for a period of time which might overheat said blower means or indicate discharge blockage; a second sensor for sensing when the membrane has inflated to an extent indicative of a substantially empty silo; means for applying vacuum to retract said flexible membrane, said second sensor controlling activation of said means for applying vacuum; and means for turning off said means for applying vacuum when said flexible membrane has returned to its non-inflated position.

16. The material-handling and storage bin of claim 15 additionally comprising supplemental blower means to aid in deflation of said flexible membrane, said supplemental blower means applying vacuum to aid in the deflation of said flexible membrane, said vacuum being applied through a plurality of conduits; and means for turning off said supplemental blower means after said flexible membrane has returned to its non-inflated position.

17. The material-handling and storage bin of claim 16 wherein said means for turning off said supplemental blower means include timer means activated at the beginning of a deflation cycle and set to turn off said supplemental blower means after said flexible membrane has returned to its non-inflated position.

18. A material-handling and storage bin of the type having a fluid-inflatable flexible membrane for assisting in gravity discharge of material after such material discharges to the extent allowed by gravity wherein said membrane assists in material discharge by nudging material into a discharge cavity through cyclical inflation of said flexible membrane such that the material discharges through a discharge opening where the membrane is secured to the bin, with improvements in controls for the bin comprising; means for applying fluid pressure to said flexible membrane; a first sensor for sensing the discharge of material, said first sensor controlling said means for applying fluid pressure to said membrane so that fluid pressure is applied to said membrane when discharge of material is not sensed and application of fluid pressure to said membrane is stopped when discharge of material is sensed; means for turning off said means for applying fluid pressure to said flexible membrne if membrane-damaging pressure is applied, means for sensing when the membrane has inflated to an extent indicative of a substantially empty silo; means for applying vacuum to retract said flexible membrane, said silo-empty sensing means controlling activation of said means for applying vacuum; the silo-empty sensing means including means for activating a fluid-pressure operated switch, the activating means operably linking the flexible membrane and the fluid-pressure operated switch such that inflation of the flexible membrane to a position indicative of a substantially empty silo activates the fluid-pressure operated switch the activated pressure-operated switch activating the means for applying vacuum at a fluid pressure indicative of a substantially empty silo; and means for turning off said means for applying vacuum when said flexible membrane has returned to its non-inflated position.

* * * * *